US008579599B2

(12) United States Patent
Leugemors et al.

(10) Patent No.: US 8,579,599 B2
(45) Date of Patent: Nov. 12, 2013

(54) SYSTEM, APPARATUS, AND METHOD FOR RAPID PUMP DISPLACEMENT CONFIGURATION

(75) Inventors: Edward Leugemors, Needville, TX (US); Rajesh Luharuka, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 498 days.

(21) Appl. No.: 12/732,265

(22) Filed: Mar. 26, 2010

(65) Prior Publication Data

US 2011/0236225 A1 Sep. 29, 2011

(51) Int. Cl.
*F04B 49/00* (2006.01)

(52) U.S. Cl.
USPC ..... 417/223; 417/53; 417/216; 417/286; 417/287; 417/319; 417/429

(58) Field of Classification Search
USPC ..... 417/53, 216, 223, 273, 286, 287, 319, 417/429
See application file for complete search history.

(56) References Cited

U.S. PATENT DOCUMENTS

| | | | | |
|---|---|---|---|---|
| 1,575,519 | A * | 3/1926 | Amsler | 73/813 |
| 1,694,589 | A * | 12/1928 | Fish | 366/136 |
| 2,561,227 | A | 6/1949 | Reed | |
| 4,264,286 | A | 4/1981 | Reinkemeyer | |
| 4,468,174 | A | 8/1984 | Pryor | |
| 4,497,614 | A | 2/1985 | Frink | |
| 4,521,163 | A | 6/1985 | Stahlkopf | |
| 4,556,371 | A * | 12/1985 | Post | 417/539 |
| 4,568,249 | A | 2/1986 | Todd | |
| 4,895,493 | A * | 1/1990 | Kletschka | 417/238 |
| 6,095,772 | A * | 8/2000 | Ramey et al. | 417/423.6 |
| 6,443,705 | B1 | 9/2002 | Munoz | |
| 6,830,535 | B2 * | 12/2004 | Wylin | 477/110 |
| 7,481,467 | B2 * | 1/2009 | Horimoto et al. | 285/377 |
| 8,074,619 | B2 * | 12/2011 | Harju | 123/197.1 |
| 8,083,504 | B2 * | 12/2011 | Williams et al. | 417/522 |
| 2004/0071560 | A1 * | 4/2004 | Cho et al. | 417/223 |
| 2004/0254042 | A1 | 12/2004 | Tsurumi | |
| 2006/0088423 | A1 | 4/2006 | Brunet et al. | |
| 2007/0041849 | A1 * | 2/2007 | Allen | 417/273 |

(Continued)

FOREIGN PATENT DOCUMENTS

| | | |
|---|---|---|
| EP | 1067067 | 1/2001 |
| WO | WO 2010053355 A1 * | 5/2010 |

OTHER PUBLICATIONS

International Preliminary Report on Patentability, Application No. PCT/IB2011/051235 filed Mar. 23, 2011, dated Oct. 2, 2012.

*Primary Examiner* — Devon Kramer
*Assistant Examiner* — Christopher Maxey
(74) *Attorney, Agent, or Firm* — Myron K. Stout; Daryl R. Wright

(57) ABSTRACT

A system for changing a pump displacement configuration includes a blender that provides low-pressure fluid to a pump. The pump has a power end and fluid end, where the fluid end includes a number of plungers. The system includes an actuator that couples the power end with a selectable subset of the plungers. The system further includes a controller that selects a subset of the plungers according to a job pumping rate, a job pumping pressure, and/or a fluid end failure event indicator. The controller further commands the actuator to couple the selected subset of the plungers to the power end.

26 Claims, 7 Drawing Sheets

(56) References Cited

U.S. PATENT DOCUMENTS

| | | | | |
|---|---|---|---|---|
| 2007/0164046 | A1* | 7/2007 | Nighy | 222/129.1 |
| 2007/0235233 | A1* | 10/2007 | Caldwell | 180/6.48 |
| 2008/0078593 | A1* | 4/2008 | Ortmann et al. | 180/65.2 |
| 2009/0041588 | A1* | 2/2009 | Hunter et al. | 417/27 |
| 2009/0304521 | A1* | 12/2009 | Kernan et al. | 417/2 |
| 2010/0243242 | A1* | 9/2010 | Boney et al. | 166/250.01 |
| 2011/0023701 | A1* | 2/2011 | Allen | 92/13.7 |
| 2011/0042413 | A1* | 2/2011 | Nighy et al. | 222/129.1 |
| 2011/0142699 | A1* | 6/2011 | Pacht | 417/437 |
| 2011/0209532 | A1* | 9/2011 | Maeda | 73/61.56 |
| 2011/0259918 | A1* | 10/2011 | Meeuwisse | 222/135 |

* cited by examiner

SYSTEM, APPARATUS, AND METHOD FOR RAPID PUMP DISPLACEMENT CONFIGURATION

BACKGROUND

The statements in this section merely provide background information related to the present disclosure and may not constitute prior art. The technical field generally relates to positive displacement pumps, and more specifically but not exclusively to high pressure positive displacement pumps. Operations with positive displacement pumps having several cylinders occasionally encounter high pressure situations, failures of one or more pumps within the pumping system, or otherwise perform pumping operations requiring a broad range of fluid rates and pressures within the same pumping operations. Changing a displacement of a pump in the present art includes utilizing a pump with a multi-speed transmission, performing operations on a pump requiring significant disassembly of the pump, and/or exposure of personnel to treating iron or other fluid conduits during high pressure pumping operations. In certain contexts, including oilfield pumping applications, shutting down pumping for extended periods during a pumping operation can be detrimental to the success of the pumping operation. Therefore, further technological developments are desirable in this area.

SUMMARY

One embodiment is a unique method for rapidly changing specific pump displacement during a pumping operation. Other embodiments include unique methods, systems, and apparatus to rapidly connect or disconnect portions of a pump fluid end from the pump power end. Further embodiments, forms, objects, features, advantages, aspects, and benefits shall become apparent from the following description and drawings.

DESCRIPTION OF THE ILLUSTRATIVE EMBODIMENTS

Figure 1:
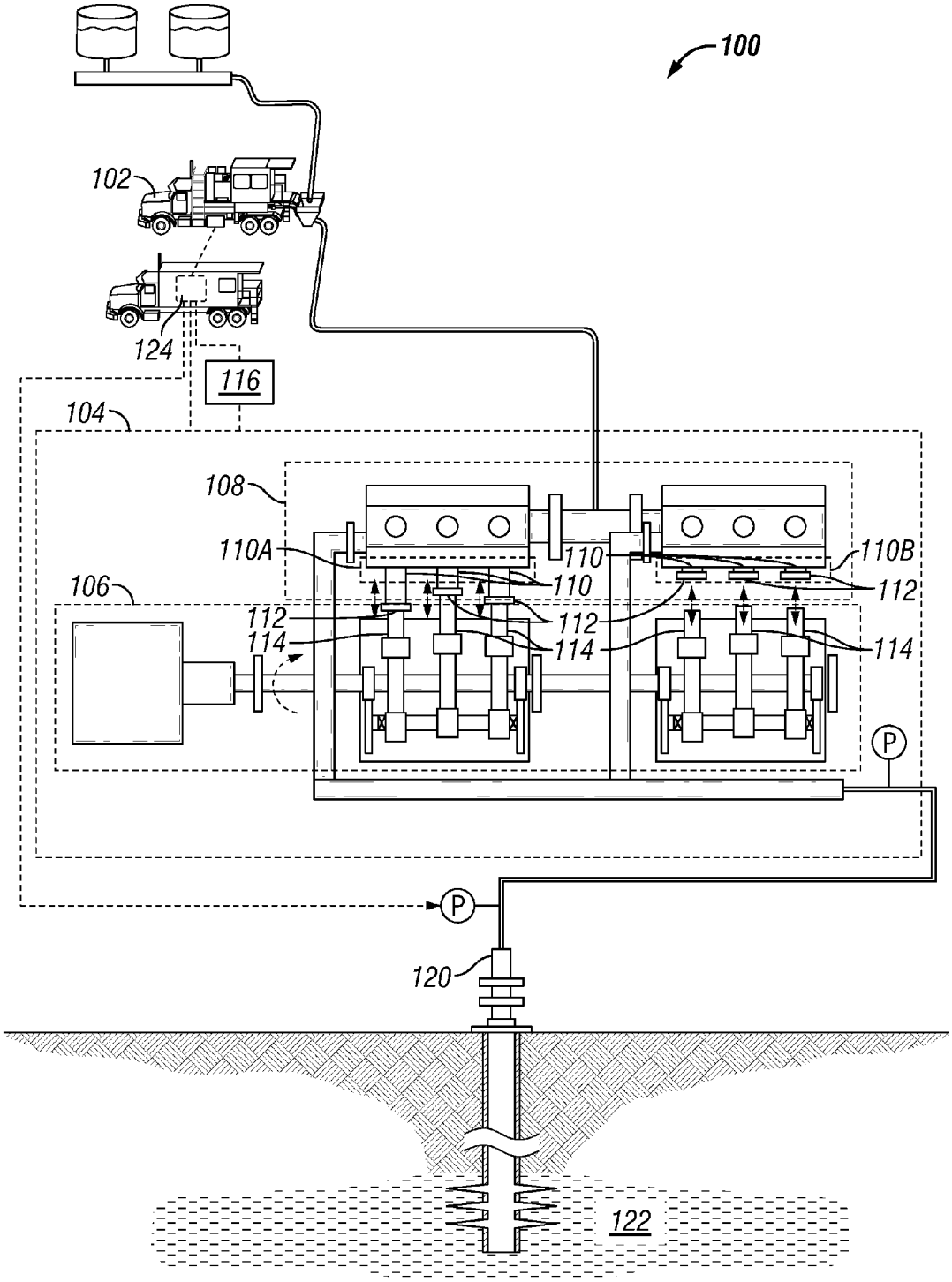
FIG. 1 is a schematic diagram of a system for rapid pump displacement configuration.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

Referencing FIG. 1, a system 100 includes a blender 102 providing low-pressure fluid to a pump 104. Low-pressure fluid, as used herein, is fluid on the low pressure side of the pump before being pressurized by the pump. The low-pressure fluid may be pressurized by the blender 102 or other delivery device, and may have a pressure significantly greater than an ambient pressure. Non-limiting examples of low-pressure fluid delivery devices include a centrifugal pump and a gravity feed device. The pump 104 includes a power end 106 and a fluid end 108 having a number of plungers 110. The power end 106 may be any pump powering mechanism or combination of mechanisms understood in the art, including at least an internal combustion engine, a hydraulic system, an electrical system, and/or a mechanical system receiving power from another device (e.g. from a power take-off shaft). The fluid end 108 receives the low-pressure fluid and provides pressurized fluid. The fluid end 108 includes pistons, cylinders, plungers 110, and/or other positive pressurizing devices understood in the art.

The system 100 includes an actuator 112 that couples the power end to a selectable subset of the plungers 110. The selectable subset includes any number of plungers 110 from zero plungers 110 (i.e. the power end is disconnected from the fluid end) to all of the plungers 110. The exemplary fluid end 108 includes a first set of plungers 110*a* and a second set of plungers 110*b*, and the fluid end 108 operates as a triplex pump when operating either set of plungers 110*a*, 110*b*, and as a six-plex fluid end when operating both sets of plungers 110*a*, 110*b*. In the position illustrated in FIG. 1, the first set of plungers 110*a* is coupled to the power end 106 and the second set of plungers 110*b* is detached from the power end 106. The second set of plungers 110*b* are withdrawn from the power end, for example by a biasing member (spring, etc.) or mechanically held (e.g. by a pin engaging a notch, not shown) such that the cycling of the pony rods 114 does not cause an impact with the second set of plungers 110*b*. In an exemplary embodiment, the first set of three plungers 110*a* includes a first specific displacement (e.g. the amount of fluid delivered by the plungers 110*a* for each rotation of the power end 106), and a second set of three plungers 110*b* includes a second specific displacement.

In certain embodiments, the system 100 further includes a controller 116 that performs certain operations for rapid configuration of a pump displacement. In certain embodiments, the controller forms a portion of a processing subsystem including one or more computing devices having memory, processing, and communication hardware. The controller 116 may be a single device or a distributed device, and the functions of the controller may be performed by hardware or software. Certain operations of the controller 116 may be performed manually by an operator, or provided as operator inputs to the controller 116 through switches, levers, and other inputs. Certain operations of the controller 116 may be performed by a computer in response to instructions provided on a computer readable medium.

The controller 116 selects the subset of the plungers 110 according to a job pumping rate, a job pumping pressure, and/or a fluid end failure event indicator. For example, the job pumping rate and/or the job pumping pressure may be provided to the controller 116 by an operator in accordance with a job design, and the controller 116 selects a subset of the plungers 110 in response to the job pumping rate and pressure. The plungers 110 may be of different sizes, for example the first set of plungers 110*a* may be smaller plungers utilized in lower rate higher pressure applications, and the second set of plungers 110*b* may be larger plungers utilized in higher rate higher pressure applications. The controller 116 determines the job pumping rate and/or pressure by any method understood in the art, including at least detecting the rate and pressure according to sensors, software values stored on a computer readable medium, values provided by switches or electronic inputs, values provided on a datalink, and/or by values provided as inputs such as a pumping rate command or a maximum pressure limitation.

In the example provided, the controller 116 selects the first set of plungers 110*a*, the second set of plungers 110*b*, or both sets of plungers 110*a*, 110*b*. The utilization of sets of three plungers is desirable from a perspective of smooth delivery of the fluid out of the pump 104. However, the controller 116 may select any number of plungers 110. For example, where the job pressure and the available power of the power end 106 require it, a single plunger 110 is selected. The controller 116 may perform any cost or benefit analysis understood in the art before selecting the plungers 110, including determining whether a job failure will occur if the pump 104 is completely unavailable to deliver fluid, determining a degree of cavitation or pressure pulsing that occurs in response to off-nominal pumping conditions, determine the values of any user overrides (e.g. a user command instructing the controller 116 to deliver fluid under any circumstances, or to discontinue pumping if groups of three plungers 110 cannot be utilized). In certain embodiments, the controller 116 may de-select specific plungers in response to a detected failure condition of the specific plunger 110 or related valves (not shown) or other components of the fluid end 108 related to the specific plunger 110.

The controller 116 further provides an actuator command in response to the selected subset of the plungers 110. In certain embodiments, the actuator command is a direct control of the actuator 112 (e.g. hydraulic, electric, pneumatic, or datalink command) that couples the selected plungers 110 from the power end 106 and de-couples the un-selected plungers 110 from the power end 106. The actuator command may be any actuator command understood in the art to effect the appropriate movement of the actuator 112, including at least a display value visible to an operator instructing the operator which plungers 110 should be coupled or de-coupled from the power end 106. In certain embodiments, the actuator command may be provided by a pre-determined value based on a pumping rate, for example a written table stored in the vicinity of the pump that instructs which plungers 110 are to be coupled and de-coupled according to the pumping rate that is to be provided by the pump 104. The written table and/or any data stored on a computer readable medium associated with the pump 104 may be updated according to the conditions of the pump 104—for example according to the size of the presently installed plungers 110 on the pump 104.

The controller 116 further selects the subset of the plungers according to a determined event. The determined events include any event known in the art that is affected by the specific displacement (i.e. the amount of fluid delivered from the pump for each rotation of the power end 106—e.g. a crankshaft 118 of the power end). Exemplary determined events include an overpressure event, a high pressure event, a low pressure event, a pump failure event, a plunger failure event, a service event, a pump startup event, a cavitation event, a blender failure event, and/or a low-pressure fluid delivery failure event. A high pressure event includes any pressure in the system 100 that is above a threshold value, for example a pressure that is high relative to the maximum force allowed at the power end 106, a high pressure relative to a maximum treatment pressure, a high pressure relative to the treating equipment (e.g. the treating iron, a casing segment at least partially exposed to treatment pressure, etc.). In one embodiment, the controller 116 disconnects the power end 106 from all of the plungers 110 in response to an overpressure event.

An embodiment of the exemplary system 100 includes a wellbore 120 fluidly coupled to a formation of interest 122, and a data gathering module 124 that determines pressure data from the wellbore 120. The data gathering module 124 may include a computer that determines data from various sensors distributed in the system 100, although any data gathering module 124 is contemplated herein. The controller 116 further selects a subset of the plungers 110 according to a treatment pressure value from a mini-frac operation performed on the formation of interest 122. For example, after the treating equipment is connected to the wellbore 120, a mini-frac treatment (a small, data gathering fracture treatment) is performed that determines at least one of a leakoff value for the formation 122, a fracture closure pressure, or other parameters, and the treatment pressure value is determined according to the data from the mini-frac operation. The treatment pressure value may be any treatment pressure that is determined from a mini-frac or other pumping diagnostic test, and can include at least any of an estimated maximum treating pressure, a pressure that will be required to break down or fracture a formation, and/or a not-to-exceed pressure such as a pressure to avoid fracturing a formation neighboring the formation of interest 122.

In certain embodiments, the controller 116 selects the subset of the plungers 110 to communicate a pressure pulse to a downhole device (not shown). Pressure pulses may be utilized to communicate with downhole tools, communicate with or respond to logging tools, or to perform any other pressure pulse operations understood in the art.

An exemplary apparatus includes the pump 104 having the power end 106 and the fluid end 108, the fluid end 108 having a number of plungers 110. The apparatus further includes the actuator 112 that couples the power end 106 with a selectable number of the plungers 110, and a controller 116 that selects a number of the plungers 110 according to a job pumping rate and/or a job pumping pressure. The controller 116 further provides an actuator command in response to the selected number of the plungers 110. The exemplary apparatus includes the pump having two groups of three plungers 110*a*, 110*b*, where the selectable number of the plungers includes the first group of three plungers 110*a*, the second group of three plungers 110*b*, and/or both of the groups of three plungers 110*a*, 110*b*. In certain embodiments, the controller 116 selects the number of the plungers according to an event including an overpressure event, a high pressure event, a low pressure event, a pump failure event, a plunger failure event, a service event, a pump startup event, a cavitation event, a blender failure event, and/or a low-pressure fluid delivery failure event. The actuator 112 may be operated manually in certain embodiments.

Figure 2:
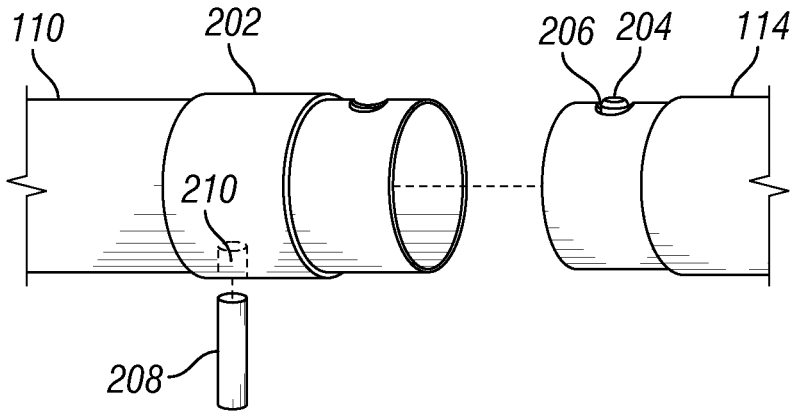
FIG. 2 is a schematic illustration of an actuator for coupling a pony rod to a plunger.

Referencing FIG. 2, an exemplary apparatus includes the actuator as a sliding sleeve 202 that engages a ball 204 in a groove 206 and/or a shaped dog (not shown). The apparatus may include multiple balls 204, for example distributed radially around the plunger 110 or the pony rod 114. The apparatus illustrated in FIG. 2 further include a key or displacement rod 208 that engages the ball, shaped dogs, and/or sliding sleeve 202. In the example of FIG. 2, the displacement rod 208 engages the sliding sleeve 202 while in proximity to the plunger 110, forcing the sleeve 202 over the ball 204 when the pony rod 114 pushes on the plunger 110 and disengaging the pony rod 114 from the plunger 110. Continued movement of the displacement rod 208 engages the rod 208 with a notch 210 in the plunger 110 holding the plunger at a most withdrawn position and preventing a collision of the plunger 110 with the pony rod 114 (although generally contact between the pony rod 114 and the plunger 110 will continue at the most extended position of the pony rod 114). In certain embodiments, the sleeve 202 may be biased (e.g. with a spring) to return to the position illustrated in FIG. 2 when the rod 208 is withdrawn, allowing the ball 204 to re-engage the pony rod 114 and the plunger 110. The ball 204 may be biased (e.g. with a spring, collapsible metal protrusion, etc.) to an outward position, while having flexibility to be pressed into the pony rod 114 when the sleeve 202 is forward. The rod 208 is affixed to a stationary portion of the fluid end 108 (not shown). The apparatus shown in FIG. 2 is illustrative only and any embodiments including a ball and groove, shaped dogs, or other coupling mechanisms are contemplated herein.

Figure 3:
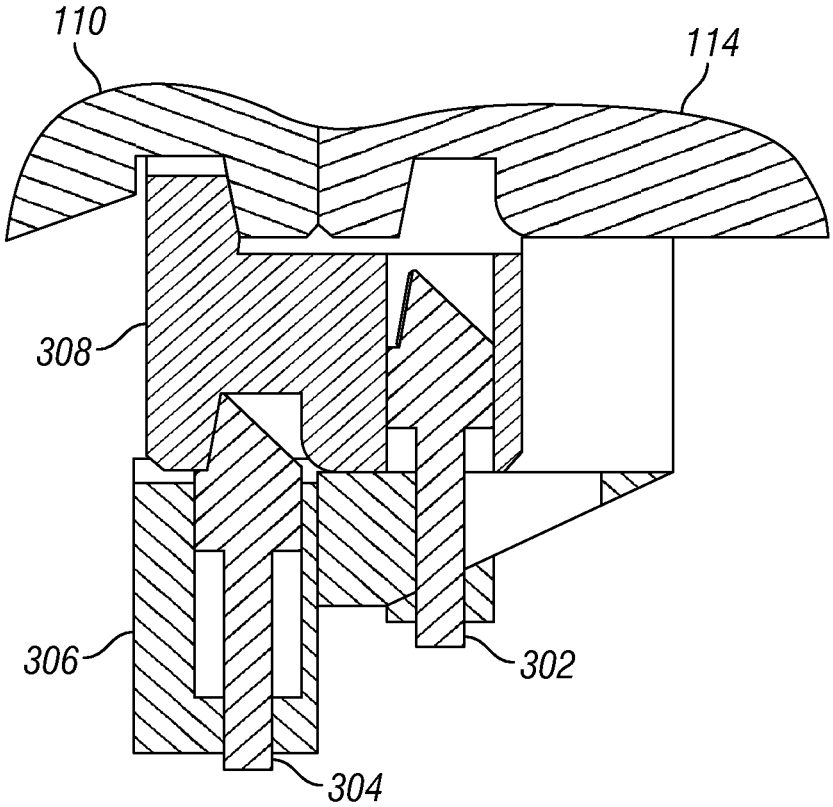
FIG. 3 is a schematic illustration of another actuator for coupling a pony rod to a plunger.

Referencing FIG. 3, an exemplary actuator includes a first pin 302 that couples a clamp 308 to a pony rod 114 in a first engaged position, and a second pin 304 that fixes the clamp 308 to a stationary portion of the fluid end 306 in a second engaged position. The actuator illustrated in FIG. 3 is shown in the second engaged position, and it can be seen as the pony rod 114 withdraws (moving to the right) the plunger 110 remains and is de-coupled from the pony rod 114.

In the first engaged position (not shown), the pin 302 moves up and engages the pony rod 114, while the second pin 304 moves down and the clamp 308 is no longer fixed to the stationary portion of the fluid end 306. It can be seen from the illustration in FIG. 3 that in the first engaged position, as the pony rod 114 withdraws, the plunger 110 moves with the pony rod 114 and the plunger 110 is thereby coupled to the power end 106 of the pump 104. The co-ordinated movement of the pins 302, 304 may be actuated and enforced by any mechanism understood in the art, including without limitation the use of spring returns or rockers. The actuation of the pins 302, 304 may be electronic, hydraulic, pneumatic, manual, or through any other mechanism known in the art, and may be operated by or at the direction of the controller 116. In certain embodiments, the controller 116 engages the first pin 302 (simultaneously or previously dis-engaging the second pin 304) to couple the power end 106 to a selected plunger 110, and engages the second pin 304 (simultaneously or previously dis-engaging the first pin 302) to de-couple the power end 106 from the selected plunger 110. Each of the plungers 110 on the pump 104 may have associated clamp(s) 308 and pins 302, 304, allowing the controller 116 to select or de-select any plunger 110.

Figure 4A:
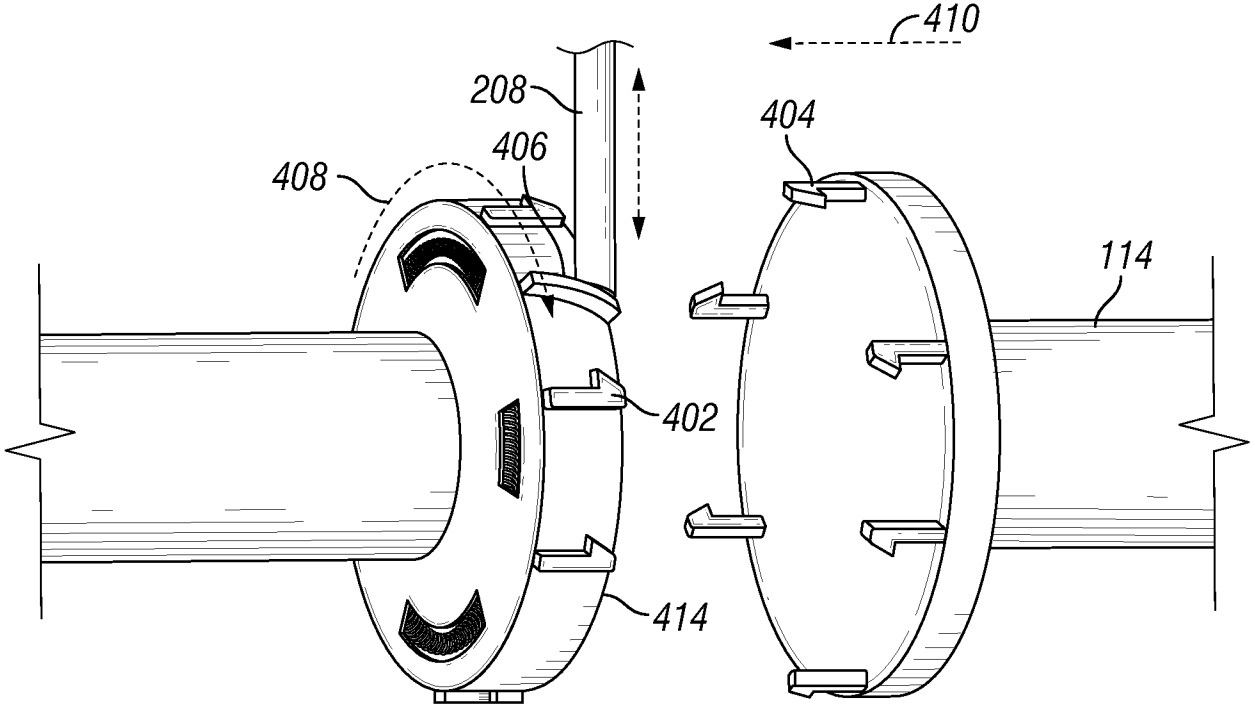
FIG. 4A is a schematic illustration of another actuator for coupling a pony rod to a plunger.
Figure 4B:
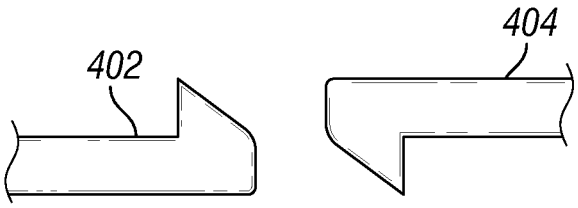
FIG. 4B is a schematic illustration of teeth coupled to a plunger engaging teeth coupled to a pony rod.
Figure 4C:
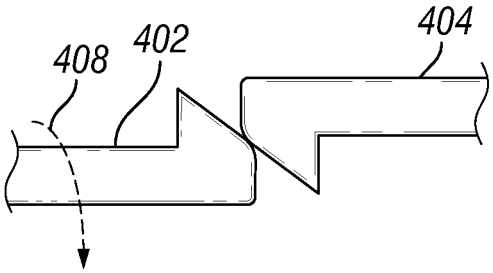
FIG. 4C is a schematic illustration of the teeth coupled to the plunger rotating past the teeth coupled to the pony rod.
Figure 4D:
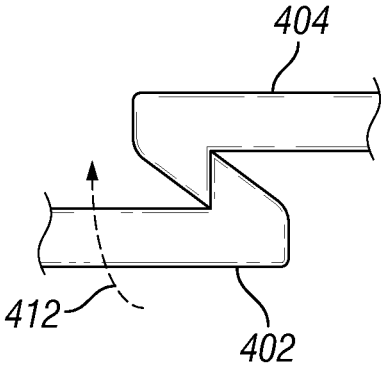
FIG. 4D is a schematic illustration of the teeth coupled to the plunger locked with the teeth coupled to the pony rod.

Referencing FIG. 4A, an exemplary actuator includes a first number of teeth 404 on a pony rod 114 that selectively engage a second number of teeth 402 on a selected plunger 110 shaft. As the dis-engaged pony rod 114 approaches the plunger 110 (moving in the direction 410 in the illustration of FIG. 4A), the teeth 404 of the pony rod 114 engage the teeth 402 of the plunger 110. In certain embodiments, the plunger 110 includes a faceplate 414 having the teeth 402, and the faceplate 414 rotates in the direction 408 relative to the plunger 114 on torsional springs (or any other mechanism providing rotational freedom to the teeth 402). After the teeth 402, 404 pass each other, the torsional springs return the faceplate 414 (rotating in the direction 412—reference FIG. 4D) thereby locking the teeth and engaging the plunger 110 to the power end through the pony rod 114. An exemplary engagement of the teeth 402, 404 is illustrated in FIGS. 4B through 4D, with the teeth 402, 404 approaching in FIG. 4B, the rotation 408 allowing the teeth 402, 404 to slip past each other in FIG. 4C, and the return rotation 412 locking the teeth 402, 404 in FIG. 4D. The number of teeth 402, 404 is selectable according to information known to one of skill in the art having the benefit of the disclosures here, and will vary according to at least desired cost, manufacturing complexity, materials used, and the forces applied during engagement, disengagement, and pumping. Additionally or alternatively, the teeth 402, 404 of one or both sides may be helically shaped to lock together torsionally upon the pony rod 114 forcibly encountering the plunger 110. In certain embodiments, only one of each tooth 402, 404 are utilized.

The apparatus illustrated in FIG. 4A includes a mechanism that holds the plunger 110 at a furthest withdrawn position when the plunger 110 is de-coupled from the pony rod 114. For example, a sliding rod 208 engages a feature on the plunger 110 to disconnect the plunger 110 from the pony rod 114 and/or to hold the plunger 110 to a maximum withdrawn position (e.g. into the fluid end 306 or at a maximum distance from the pony rod 114). In the embodiment of FIG. 4A, the cam 208 engages a helical tooth 406 provided on a circumference of the faceplate 414, forcing rotation (in the direction 408) of the faceplate 414 to disengage the teeth 402 and holding the plunger 110 to the maximum withdrawn position. Any actuator or combination of actuators understood in the art to rotate and withdraw the plunger 110, including without limitation engaging a groove on the plunger 110, is contemplated herein. In certain embodiments, the cam 208 engages the helical tooth 406 when the pony rod 114 is fully extended toward the fluid end (i.e. the plunger 110 is at top dead center), where the engaging force of the teeth 402, 404 is at a minimum or in certain embodiments has a small amount of slack.

Figure 5A:
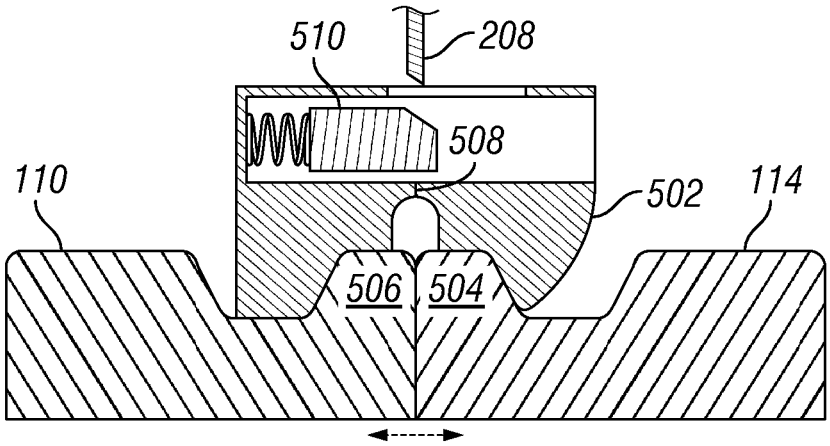
FIG. 5A is a schematic illustration of another actuator for coupling a pony rod to a plunger, in an engaged position.
Figure 5B:
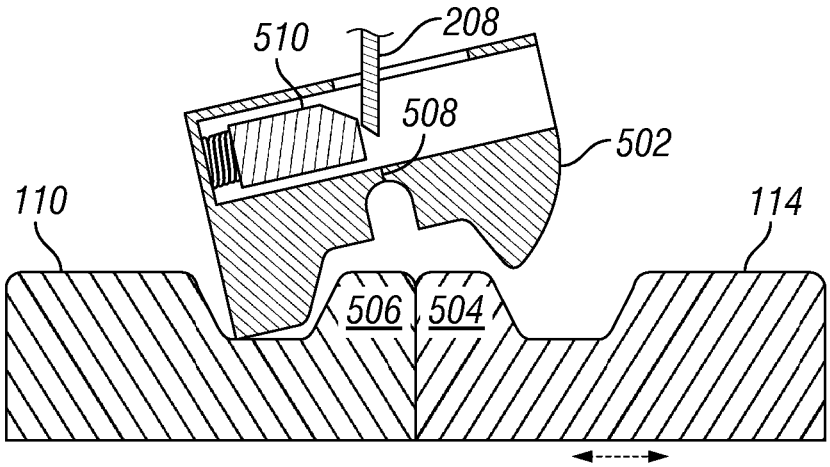
FIG. 5B is a schematic illustration the actuator for coupling the pony rod to the plunger, in a disengaged position.

In certain embodiments, the pony rod 114 includes a pony rod lip 504 and the plunger 110 includes a plunger lip 506. A clamp 502 couples or de-couples the pony rod 114 and the plunger 110 by engaging or dis-engaging the lips 504, 506. The clamp 502 may be a rigid clamp encompassing both lips 504, 506, and may have a quick disconnect lever or other device. For example, a Style 78 Snap-Joint Coupling, sold by Victualic Company, 4901 Kesslersville Road, Easton, Pa., or a similar device, may be utilized in certain embodiments. A clamp 502 may be operated mechanically, electromagnetically, thermally, or by any other means understood in the art. Referencing FIG. 5A, a clamp 502 couples a pony rod lip 504 to a plunger lip 506, where the clamp 502 includes a flexible clamping member (e.g. a flexible point 508 or hinge) and a stabilizing pin 510. The stabilizing pin 510 in the illustration of FIG. 5A is biased into the stabilizing position that couples the pony rod lip 504 to the plunger lip 506. The actuator further includes a displacement rod 208 that moves the stabilizing pin 510 into a release position, allowing the flexible point 508 to flex and thereby de-couple the pony rod lip 504 from the plunger lip 506 (reference FIG. 5B). The displacement rod 208 may additionally hold the plunger 110 at a most withdrawn position to prevent impacts between the plunger 110 and the pony rod 114. A release of the displacement rod 208 allows the stabilizing pin 510 to return the clamp 502 to a position where a next encounter of the pony rod 114 will couple the plunger 110 to the pony rod 114.

Figure 6A:
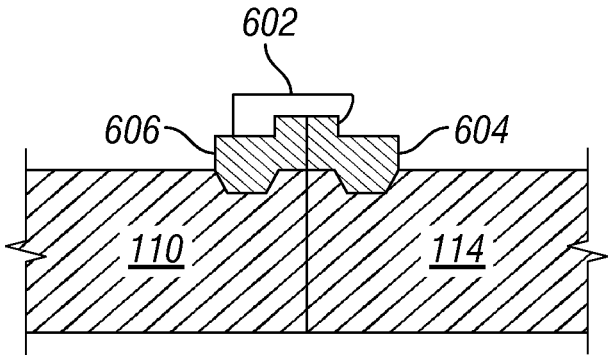
FIG. 6A is a schematic illustration of a side view of another actuator for coupling a pony rod to a plunger, in an engaged position.
Figure 6B:
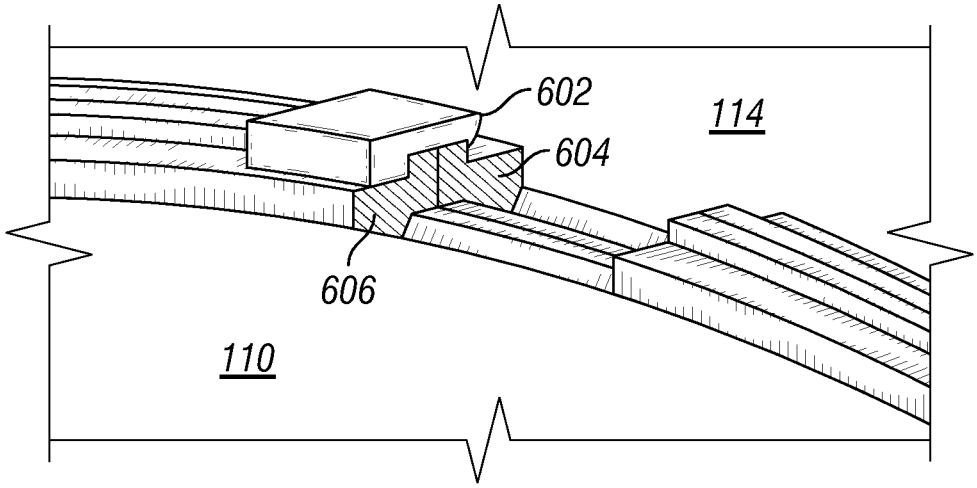
FIG. 6B is a schematic illustration of a perspective view of the actuator for coupling a pony rod to a plunger, in the engaged position.
Figure 6C:
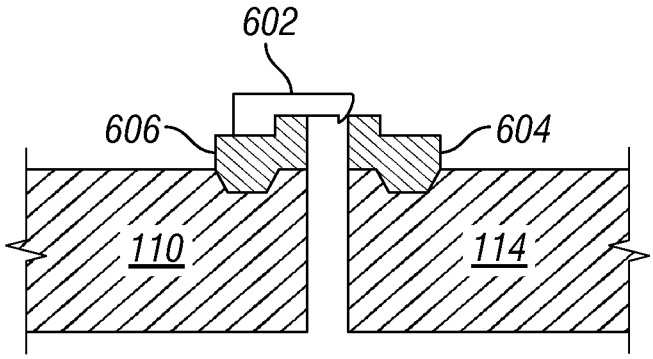
FIG. 6C is a schematic illustration of a side view of the actuator for coupling the pony rod to the plunger, in a disengaged position.
Figure 6D:
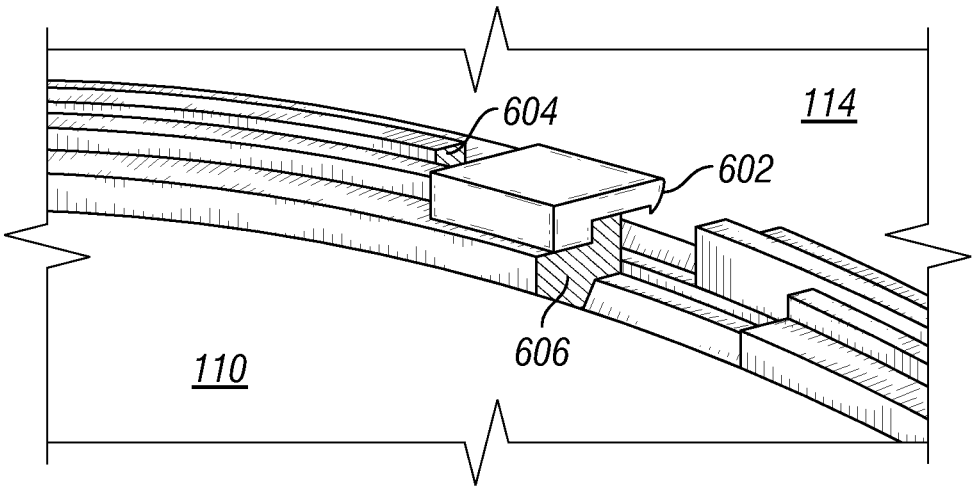
FIG. 6D is a schematic illustration of a perspective view of the actuator for coupling the pony rod to the plunger, in the disengaged position.

Another exemplary apparatus includes the actuator having a dog tooth clamp 602 that couples a pony rod protrusion 604 to a plunger protrusion 606. A rotation of the plunger 110 (or the pony rod 114, although generally the pony rod 114 is rotationally fixed) to an engaged position engages the dog tooth clamp 602 with an opposing protrusion. Referencing FIG. 6A, a side view shows the dog tooth clamp 602 engaging the pony rod protrusion 604, and FIG. 6B illustrates a perspective view of the dog tooth clamp 602 engaging the pony rod protrusion 604. In the illustration of FIG. 6A, the dog tooth clamp 602 is fixed on the plunger 110, but dog tooth clamp 602 may alternatively be included on the pony rod 114, or a number of dog tooth clamps 602 may be provided, with some on the pony rod 114 and some on the plunger 110. A rotation of the plunger 110 (or the pony rod 114) to a disengaged position dis-engages the dog tooth clamp 602 from the opposing protrusion, and when the pony rod 114 withdraws from the plunger 110 the pony rod 114 moves freely away without being coupled to the plunger 110. Referencing FIG. 6C, a side view shows the dog tooth claim 602 rotated and dis-engaged from the pony rod protrusion 604, and FIG. 6C illustrates a perspective view of the dog tooth claim 602 dis-engaged from the pony rod protrusion 604. The plunger 110 and/or pony rod 114 may be resistant to rotation, and the actuator provides force on the plunger 110 (or pony rod 114) to rotate between the engaged and disengaged positions. In certain embodiments, the plunger 110 (or pony rod 114) may be biased to one of the engaged or disengaged positions, or may rotate during normal movement (randomly, freely, or slightly), and a stabilizing pin (not shown) may prevent relative rotation of the selected plunger 110 (or pony rod 114) such that the selected position (engaged or disengaged) is maintained.

The following descriptions provide illustrative embodiments of performing procedures for rapidly configuring a pump displacement. Operations illustrated are understood to be exemplary only, and operations may be combined or divided, and added or removed, as well as re-ordered in whole or part, unless stated explicitly to the contrary herein. Certain operations described may be implemented by a computer executing a computer program product on a computer readable medium, where the computer program product comprises instructions causing the computer to execute one or more of the operations, or to issue commands to other devices to execute one or more of the operations.

A procedure includes an operation to pump a first displacement amount of a fluid from a positive displacement pump having a first number of plungers with a rotation of a power end of the pump. The first displacement amount is related to the swept volume of the first number of plungers in response to the rotation of the power end of the pump (e.g. less any volumetric efficiency losses), and will be further related to the area of the face of the plungers. The procedure further includes an operation to change the first number of plungers to a second number of plungers, and to pump a second displacement amount of the fluid from the positive displacement pump, having the second number of plungers, with a rotation of the power end of the pump. In certain embodiments, the second displacement amount of the fluid is a distinct amount of fluid from the first displacement amount (i.e. the swept volume of the second amount of plungers is different from the swept volume of the first amount of plungers). In certain additional embodiments, the second amount of plungers may: include the first amount of plungers, be a different set of plungers from the first amount of plungers, or be a set of plungers that is a partial or complete subset of the first amount of plungers.

An exemplary operation of the procedure includes changing the plungers by switching from one set of three plungers to a second set of three plungers. An alternate operation of the procedure includes adding a set of plungers, subtracting a set of plungers, and/or de-coupling all of the plungers from the power end. The operation to change the plungers further includes, in certain embodiments, an operation to determine that a pumping pressure has increased past a threshold, and to perform the operation to change the plungers in response to the pumping pressure increasing past the threshold.

The exemplary procedure may be performed remotely or by an operator located at the pump. An exemplary procedure includes an operation to select the first set of plungers, the second set of plungers, or both sets of plungers, thereby operating a six-plex pump at a selectable one of three distinct specific displacement values. Another exemplary procedure includes starting the pump in an ongoing pumping operation (e.g. with other fluidly coupled pumps already pumping) with a first plunger or number of plungers, and increasing the number of plungers to the second number of plungers after the pump is started. The first number of plungers and/or the second number of plungers may include a single plunger, or zero plungers where a change in the plungers occurs in response to an overpressure event or other pump shutdown situation.

In certain embodiments, the changing from the first number of plungers to the second number of plungers occurs within a changing time value. The changing time value varies according to the specific system and the purpose of the change in the plungers. In certain embodiments, a rapid change is desirable (e.g. in a near-screenout situation due to fluid leakoff where a lengthy shutdown may risk pumping job failure) and available (e.g. a rapid actuator response is possible such as an automated sliding sleeve, displacement rod, etc.) and the changing time value is less than five seconds. In certain embodiments, dependent upon the actuator mechanism which will be understood by one of skill in the art having the benefit of the disclosures herein, the changing time value is less than ten seconds (e.g. manual quick-disconnect clamps in certain embodiments) or less than thirty seconds (e.g. where several operations to roll the pumps during changeover are required, dependent upon the pump controls and response). In certain embodiments, the changing time value may be less than sixty seconds, or a time greater than sixty seconds. The changing time values described herein are exemplary, and depend upon the specific requirements and implementation of the system. In certain embodiments, the changing is performed without stopping pumping operations of the pump.

Yet another exemplary procedure includes an operation to fluidly couple a pump having a number of plungers to a fluid line, an operation to couple a first subset of the plungers to a power end of the pump, and an operation to pump a fluid through the fluid line with the first subset of the plungers. The procedure further includes an operation to pump the fluid through the fluid line with the first subset of the plungers, an operation to couple a second subset of the plungers to the power end of the pump, and an operation to pump the fluid through the fluid line with the second subset of the plungers. The exemplary procedure further includes an operation to determine a treatment pressure value, and to perform the operation to couple the second subset of the plungers in response to the treatment pressure value.

Determining the treatment pressure value includes determining any treatment pressure value understood in the art that either indicates a different pump specific displacement (e.g. plunger head size) is desirable, or that a specific plunger or set of plungers has experienced a failure or requires maintenance. Exemplary operations to determine the treatment pressure value include determining the treatment pressure value from a mini-frac operation, determining a maximum treatment pressure observed during the pumping (which may be updated during the pumping), and/or predicting a maximum treatment pressure in response to pressures observed during the pumping with the first subset of the plungers. For example, the determination of the treatment pressure value may include an estimation that a maximum pressure allowable for the first set of plungers will be exceeded at a later point during a pumping operation, and a switch is made to the second set of plungers before the maximum pressure allowable is achieved. In certain embodiments, the procedure includes an operation to detect a fluid end failure event corresponding to the first subset of the plungers, and the operation to couple the second subset of the plungers in response to the fluid end failure event.

The exemplary procedure further includes an operation to provide a pressure pulse to a downhole device. Pressure pulses may be utilized to communicate with downhole tools, communicate with or respond to logging tools, or to perform any other pressure pulse operations understood in the art. In certain further embodiments, the procedure includes an operation to hold the first plurality of plungers at a most withdrawn position from the power end after the changing. Thereby, the dis-engaged plungers do not collide with the pony rods of the power end during operations.

As is evident from the figures and text presented above, a variety of embodiments according to the present invention are contemplated.

An exemplary method includes pumping a first displacement amount of a fluid from a positive displacement pump having a first number of plungers with a rotation of a power end of the pump, changing the first number of plungers to a second number of plungers, and pumping a second displacement amount of the fluid from the positive displacement pump having the second number of plungers with a rotation of the power end of the pump. The exemplary method further includes changing the plungers by switching from one set of three plungers to a second set of three plungers. The changing may include adding a set of plungers, or subtracting a set of plungers, including de-coupling all of the plungers from the power end. In certain embodiments, the method further includes determining that a pumping pressure has increased past a threshold, and performing the changing in response to the pumping pressure increasing past the threshold.

The exemplary method may be performed remotely. In certain embodiments, the first set of plungers has a first specific displacement and a second set of plungers having a second specific displacement, where the specific displacement is proportional to an amount of fluid pumped for each rotation of the power end. The exemplary method further includes selecting one of the first set of plungers, the second set of plungers, and both sets of plungers, thereby allowing a six-plex pump to operate at three distinct specific displacement values. The method further includes starting the pump in an ongoing pumping operation (e.g. with other fluidly coupled pumps already pumping) with the first plurality of plungers, and increasing the number of plungers to the second plurality of plungers after the pump is started. In certain embodiments, the first number of plungers and/or the second number of plungers may be a single plunger. In certain embodiments, the changing occurs within a changing time value that is less five seconds, ten seconds, thirty seconds, and/or sixty seconds. In certain embodiments, the changing is performed without stopping pumping operations of the pump. The exemplary method further includes providing a pressure pulse to a downhole device, and/or holding the first plurality of plungers at a most withdrawn position from the power end after the changing.

Another exemplary embodiment is an apparatus including a pump having a power end and a fluid end, the fluid end having a number of plungers. The apparatus further includes an actuator that couples the power end with a selectable number of the plungers, and a controller that selects a number of the plungers according to a job pumping rate and/or a job pumping pressure. The controller further provides an actuator command in response to the selected number of the plungers. The exemplary apparatus includes the pump having two groups of three plungers, where the selectable number of the plungers includes a first group of three plungers, a second group of three plungers, and/or both of the groups of three plungers. In certain embodiments, the controller selects the number of the plungers according to an event including an overpressure event, a high pressure event, a low pressure event, a pump failure event, a plunger failure event, a service event, a pump startup event, a cavitation event, a blender failure event, and/or a low-pressure fluid delivery failure event.

The exemplary apparatus includes the actuator as a sliding sleeve that engages a ball in a groove and/or a shaped dog, and may further include a key or displacement rod that engages the sliding sleeve, the ball, and/or the shaped dog. In certain embodiments, the actuator includes a first pin that couples a clamp to a pony rod in a first engaged position and a second pin that fixes the clamp to a stationary portion of the fluid end in a second engaged position. The controller engages the first pin to couple the power end to a selected plunger, and engages the second pin to de-couple the power end from the selected plunger.

In certain embodiments, the actuator includes a first number of teeth on a pony rod that selectively engage a second number of teeth on a selected plunger shaft, and a pin that engages a helical gear that selectively locks the first plurality and second plurality of teeth into engagement. In an additional or alternate embodiment, the actuator includes a clamp that couples a pony rod lip to a plunger lip, where the clamp includes a flexible clamping member and a stabilizing pin. The stabilizing pin is biased into a stabilizing position that couples the pony rod lip to the plunger lip. The actuator further includes a displacement rod that moves the stabilizing pin into a release position that de-couples the pony rod lip from the plunger lip.

An exemplary apparatus includes the actuator having a dog tooth clamp that couples a pony rod protrusion to a plunger protrusion. The actuator further includes a stabilizing pin that prevents relative rotation of a selected plunger having the plunger protrusion and a pony rod having the pony rod protrusion. Rotation of the plunger and/or the pony rod may be utilized to engage and disengage the plunger and the pony rod.

Yet another exemplary embodiment is a system, including a blender providing low-pressure fluid to a pump, where the pump includes a power end and fluid end having a number of plungers. The system includes an actuator that couples the power end to a selectable subset of the plungers. The selectable subset includes any number of plungers from zero plungers (i.e. the power end is disconnected from the fluid end) to all of the plungers. The system further includes a controller that selects the subset of the plungers according to a job pumping rate, a job pumping pressure, and/or a fluid end failure event indicator, and that provides an actuator command in response to the selected subset of the plungers. The controller further selects the subset of the plungers according to an event including: an overpressure event, a high pressure event, a low pressure event, a pump failure event, a plunger failure event, a service event, a pump startup event, a cavitation event, a blender failure event, and/or a low-pressure fluid delivery failure event. The exemplary system includes the controller is further structured to select the subset of the plungers to communicate a pressure pulse to a downhole device. The controller further disconnects the power end from all of the plungers in response to an overpressure event. In certain embodiments, the selectable subsets of the plungers include a first set of three plungers having a first specific displacement, and a second set of three plungers having a second specific displacement.

An embodiment of the exemplary system includes a wellbore fluidly coupled to a formation of interest, and a data gathering module that determines pressure data from the wellbore. The controller further selects a subset of the plungers according to a treatment pressure value from a mini-frac operation performed on the formation of interest.

Yet another exemplary embodiment is a method including fluidly coupling a pump having a number of plungers to a fluid line, coupling a first subset of the plungers to a power end of the pump, pumping a fluid through the fluid line with the first subset of the plungers, and after the pumping the fluid through the fluid line with the first subset of the plungers, coupling a second subset of the plungers to the power end of the pump and pumping the fluid through the fluid line with the second subset of the plungers. The exemplary method further includes determining a treatment pressure value, and coupling the second subset of the plungers in response to the treatment pressure value. Determining the treatment pressure value includes performing a pressure determination operation such as: determining the treatment pressure value from a mini-frac operation, determining a maximum treatment pressure observed during the pumping, and/or predicting a maximum treatment pressure in response to pressures observed during the pumping with the first subset of the plungers. In certain embodiments, the method includes detecting a fluid end failure event corresponding to the first subset of the plungers, and coupling the second subset of the plungers in response to the fluid end failure event.

While the invention has been illustrated and described in detail in the drawings and foregoing description, the same is to be considered as illustrative and not restrictive in character, it being understood that only certain exemplary embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A method, comprising:

pumping a first displacement amount of a fluid from a positive displacement pump having a first plurality of plungers with a rotation of a power end of the pump;

changing the first plurality of plungers to a second plurality of plungers, wherein changing comprises coupling a first plurality of teeth on a pony rod with a second plurality of teeth on a plunger shaft, and further comprising a pin engaging a helical gear that selectively disengages the first plurality of teeth and the second plurality of teeth; and pumping a second displacement amount of the fluid from the positive displacement pump having the second plurality of plungers with a rotation of the power end of the pump.

2. The method of claim 1, wherein the changing further comprises switching from one set of three plungers to a second set of three plungers.

3. The method of claim 1, wherein the changing further comprises one of adding or subtracting a set of three plungers from the first plurality of plungers.

4. The method of claim 1, further comprising determining that a pumping pressure has increased past a threshold, and performing the changing in response to the pumping pressure increasing past the threshold.

5. The method of claim 1, wherein the changing is performed remotely.

6. The method of claim 1, wherein the pump further comprises a first set of plungers having a first specific displacement and a second set of plungers having a second specific displacement.

7. The method of claim 6, wherein the changing further comprises selecting one of the first set of plungers, the second set of plungers, and both sets of plungers.

8. The method of claim 1, further comprising starting the pump in an ongoing pumping operation with the first plurality of plungers, and increasing the number of plungers to the second plurality of plungers after the pump is started.

9. The method of claim 1, wherein the changing further comprises a changing time value less than a time selected from the changing time values consisting of: five seconds, ten seconds, thirty seconds, and sixty seconds.

10. The method of claim 1, wherein the changing is performed without stopping pumping operations of the pump.

11. The method of claim 1, further comprising providing a pressure pulse to a downhole device.

12. The method of claim 1, further comprising holding the first plurality of plungers at a most withdrawn position from the power end after the changing.

13. An apparatus, comprising:

a pump having a power end and a fluid end comprising a plurality of plungers;

an actuator structured to couple the power end with a selectable number of the plungers, wherein the actuator comprises a first plurality of teeth on a pony rod that selectively engage a second plurality of teeth on a plunger shaft;

a pin engaging a helical gear that selectively disengages the first plurality of teeth and the second plurality of teeth; and a controller structured to select the number of the plungers according to at least one of a job pumping rate and a job pumping pressure, and to provide an actuator command in response to the selected number of the plungers.

14. The apparatus of claim 13, wherein the pump comprises two groups of three plungers, and wherein the selectable number of the plungers comprises a first group of three plungers, a second group of three plungers, and both of the groups of three plungers.

15. The apparatus of claim 13, wherein the controller is further structured to select the number of the plungers according to an event selected from the events consisting of: an overpressure event, a high pressure event, a low pressure event, a pump failure event, a plunger failure event, a service event, a pump startup event, a cavitation event, a blender failure event, and a low-pressure fluid delivery failure event.

16. The apparatus of claim 13, wherein the pin further selectively holds the plunger shaft at a most withdrawn position from the pony rod.

17. A system, comprising:

a blender providing low-pressure fluid to a pump, the pump having a power end and fluid end comprising a plurality of plungers;

an actuator structured to couple the power end with a selectable subset of the plungers, wherein the actuator comprises a first plurality of teeth on a pony rod that selectively engage a second plurality of teeth on a plunger shaft, and a pin engaging a helical gear that selectively disengages the first plurality of teeth and the second plurality of teeth;

a controller structured to:

select the subset of the plungers according to at least one of a job pumping rate, a job pumping pressure, and a fluid end failure event indicator; and provide an actuator command in response to the selected subset of the plungers.

18. The system of claim 17, wherein the controller is further structured to select the subset of the plungers according to an event selected from the events consisting of: an overpressure event, a high pressure event, a low pressure event, a pump failure event, a plunger failure event, a service event, a pump startup event, a cavitation event, a blender failure event, and a low-pressure fluid delivery failure event.

19. The system of claim 17, wherein the controller is further structured to select the subset of the plungers to communicate a pressure pulse to a downhole device.

20. The system of claim 17, wherein the controller is further structured to disconnect the power end from all of the plungers in response to an overpressure event.

21. The system of claim 17, wherein the selectable subsets of the plungers include a first set of three plungers having a first specific displacement and a second set of three plungers having a second specific displacement.

22. The system of claim 17, further comprising a wellbore fluidly coupled to a formation of interest and a data gathering module structured to determine pressure data from the wellbore, and wherein the controller is further structured to select the subset of the plungers according to a treatment pressure value from a mini-frac operation performed on the formation of interest.

23. A method, comprising:

fluidly coupling a pump having a plurality of plungers to a fluid line;

coupling a first subset of the plungers to a power end of the pump with an actuator having a first number of teeth on a pony rod that selectively engage a second number of teeth on a selected plunger shaft, and a pin that engages a helical gear that selectively locks the first plurality and second plurality of teeth into engagement;

pumping a fluid through the fluid line with the first subset of the plungers; and after pumping the fluid through the fluid line with the first subset of the plungers, coupling a second subset of the plungers to the power end of the pump and pumping the fluid through the fluid line with the second subset of the plungers.

24. The method of claim 23, further comprising determining a treatment pressure value, and coupling the second subset of the plungers in response to the treatment pressure value.

25. The method of claim 24, wherein determining the treatment pressure value comprises performing a pressure determination operation selected from the operations consisting of:

determining the treatment pressure value from a mini-frac operation;

determining a maximum treatment pressure observed during the pumping; and predicting a maximum treatment pressure in response to pressures observed during the pumping with the first subset of the plungers.

26. The method of claim 23, further comprising detecting a fluid end failure event corresponding to the first subset of the plungers, and coupling the second subset of the plungers in response to the fluid end failure event.

* * * * *